US005201467A

United States Patent [19]

Kennel et al.

[11] Patent Number: 5,201,467

[45] Date of Patent: Apr. 13, 1993

[54] APPARATUS FOR INTERCONNECTING ELASTOMERIC GRADE CROSSING PANELS

[75] Inventors: Gerald R. Kennel, McHenry; John A. Perry, Harvard, both of Ill.

[73] Assignee: Riedel Omni Rubber Products, Inc., Portland, Oreg.

[21] Appl. No.: 754,055

[22] Filed: Sep. 3, 1991

[51] Int. Cl.[5] ..... E01B 21/04; E01C 5/20

[52] U.S. Cl. ..... 238/8; 404/34; 404/40

[58] Field of Search ..... 238/2, 8, 9, 10 R, 10 C, 238/12, 382; 404/32-35, 40, 41, 50, 51, 60

[56] References Cited

U.S. PATENT DOCUMENTS

| | | | |
|---|---|---|---|
| 2,828,080 | 3/1958 | Rennels | 404/34 X |
| 2,984,417 | 5/1961 | Voorhees | 404/34 X |
| 3,922,105 | 11/1975 | Bolli | 404/34 |
| 3,972,640 | 8/1976 | Miller | 404/40 X |
| 4,365,743 | 12/1982 | Trickel | 404/41 X |
| 4,368,845 | 1/1983 | Perry et al. | 238/8 |
| 4,457,468 | 7/1984 | Hales | 238/8 |
| 4,516,876 | 5/1985 | Wicks | 404/51 X |
| 4,697,294 | 10/1987 | Schafer | 404/40 X |
| 4,808,025 | 2/1989 | McGinnis | 404/32 X |
| 5,096,117 | 3/1992 | Owen | 238/8 |
| 5,098,218 | 3/1992 | Reese et al. | 404/35 |

FOREIGN PATENT DOCUMENTS

| | | | |
|---|---|---|---|
| 32105 | 7/1981 | European Pat. Off. | 404/60 |
| 1076724 | 3/1960 | Fed. Rep. of Germany | 238/8 |
| 619709 | 4/1927 | France | 404/40 |

*Primary Examiner*—Frank E. Werner
*Assistant Examiner*—Scott L. Lowe
*Attorney, Agent, or Firm*—Chernoff, Vilhauer, McClung & Stenzel

[57] ABSTRACT

A railroad grade crossing comprising a plurality of elastomeric panels that are interconnected to provide integral multiple panel crossing units. Each panel has a plurality of elongate tapered cylindrical passageways extending through it that are parallel with the tracks being crossed. Pins are partially inserted into aligned passageways in adjacent panels to interconnect adjacent panels to one another. Because the passageways are tapered, and thus create larger openings at one end of the panels and smaller openings at the other ends, the pins are divided into larger ends, which fit into the larger openings, and smaller ends, which fit into the smaller openings. If it is desired to interconnect the panels into integrated crossing units prior to installation, the pins can be attached to the passageways and the ends of adjacent panels can be attached to one another with an adhesive. This permits the combined crossing units to be transported and installed as a unit. In this case attachment devices are placed integrally in the panels to facilitate lifting the crossing units with a crane. End restraints are attached to the ties at the ends of the crossing to prevent the crossing units from moving along the tracks.

10 Claims, 4 Drawing Sheets

APPARATUS FOR INTERCONNECTING ELASTOMERIC GRADE CROSSING PANELS

BACKGROUND AND SUMMARY OF THE INVENTION

This invention relates to elastomeric grade crossing panels, and in particular to the interconnection of several such panels to form integral grade crossing units.

Elastomeric grade crossing panels have come into wide use because they provide a smoother more durable crossing than other types of material. Panels of this general type are described in Trickel et al., U.S. Pat. No. 4,365,743. The panels typically are rubber and are cast in an enclosed mold. The panels normally are narrower than a roadway and thus several panels must be placed end-to-end to form the crossing. These individual panels are not heavy enough to prevent them from being lifted, and thus displaced, when vehicular traffic passes over them, so they must be attached to the ties that support them. Attaching the crossing panels to the ties not only is labor intensive, and thus increases the cost of the crossing, but it makes it difficult to remove the crossing to retamp the ballast that supports the ties. In addition, while the panels can be attached to wood ties with fasteners, attaching them to concrete ties creates more of a problem.

The subject invention overcomes the difficulties associated with attaching elastomeric grade crossing panels to ties by interconnecting the panels to one another to create integrated crossing units which are sufficiently heavy that they do not have to be attached to the ties.

When elastomeric grade crossing panels are formed it is desirable to place cylindrical metal rods in the mold in order to speed curling. Thus, cylindrical passageways are formed in the finished panels. These rods are tapered in order to facilitate their removal from the panels, which causes the passageways to be tapered also. The subject invention utilizes these passageways to interconnect the panels by providing pins which extend into the passageways of adjacent panels. The pins are divided into a larger end, which fits into the larger end of the tapered passageway located at one end of the panel, and a smaller end, which fits into the smaller end of the tapered passageway located at the other end of the panel. The pins preferably are made from an elastomeric material in order to grip the panels. If the pins are elastomeric they preferably have a metal core to increase their rigidity.

In one embodiment of the invention, the pins are attached to the panels with an adhesive. In addition, the abutting edges of the panels are adhered to one another with an adhesive. This permits the panels to be interconnected in advance and transported and installed as an integral unit. In this embodiment the panels have attachment devices installed in them for lifting the combined crossing units with a crane or back hoe. The attachment devices are movable between retracted positions where they are stored in the panels and extended positions where they project from the panels.

In a second embodiment of the invention, the panels are interconnected as they are installed and an adhesive is not used. In either case each integrated crossing unit is sufficiently heavy that it will not lift when driven on. Thus, the panels do not have to be attached to the ties. However, with time the crossing units will move along the tracks and eventually become displaced from the roadway. To prevent this from occurring, end restraints are placed at each end of the crossing. The end restraints are attached to the ties using conventional attachment techniques.

Accordingly, it is a principal object of the subject invention to interconnect adjacent elastomeric grade crossing panels to one another to create integral crossing units.

It is a further object of the subject invention to provide such crossing units which can be transported and installed as a single unit.

It is a still further object of the subject invention to provide such crossing units having integral attachment devices to facilitate lifting the crossing unit with a crane or back hoe.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
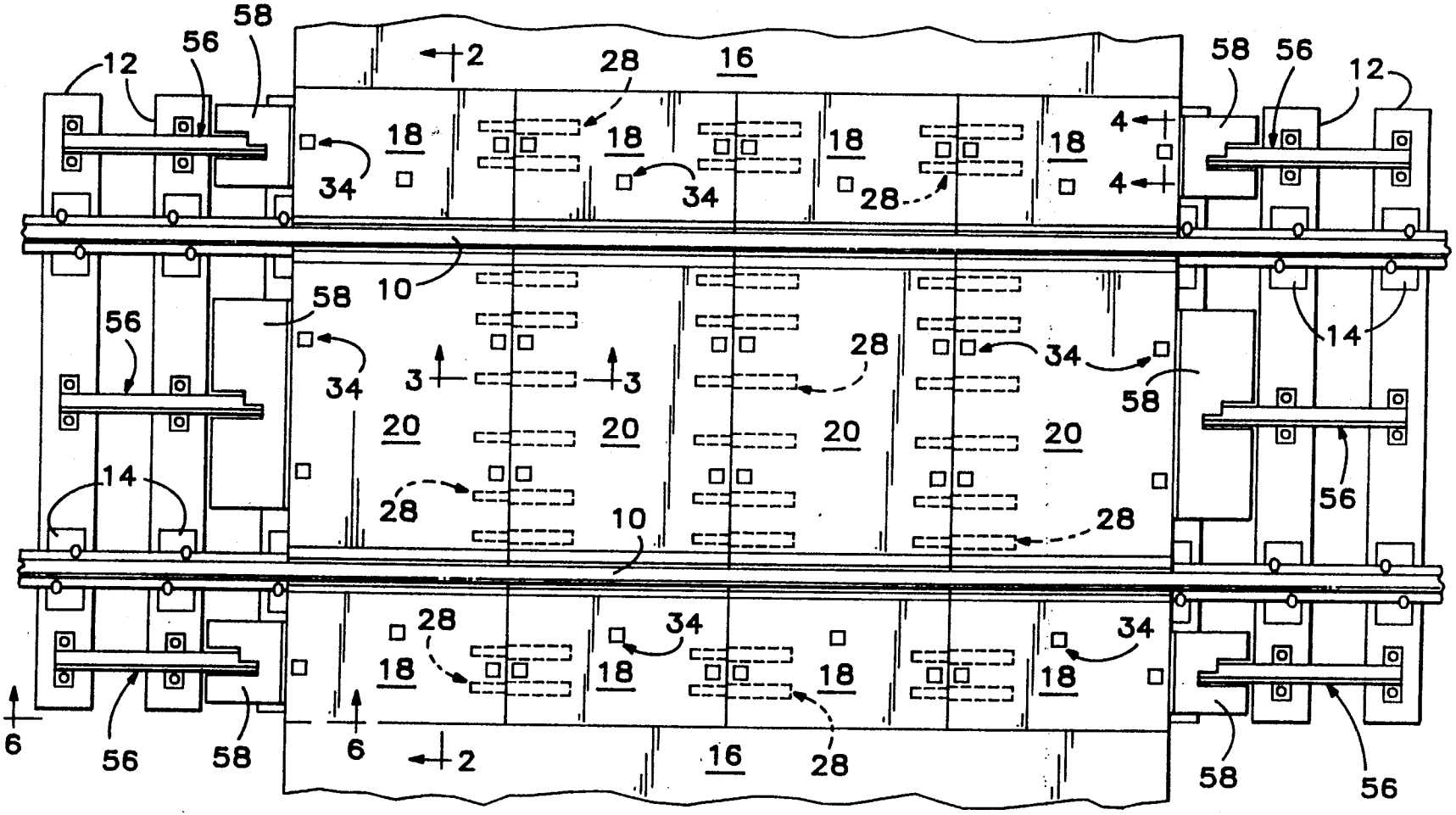
FIG. 1 is a plan view of a railroad grade crossing embodying the interconnect system of the subject invention.

Referring to FIG. 1 of the drawings, a railroad track comprises a pair of parallel, spaced-apart rails 10 that are attached to lateral ties 12 by attachment devices 14. A roadway 16 that crosses the tracks terminates at the ends of the ties. The space between the rails and the roadway is filled with elastomeric field panels 18, and the space between the rails is filled with elastomeric gauge panels 20. Panels of this general type are disclosed in Trickel et al., U.S. Pat. No. 4,365,743.

Figure 2:
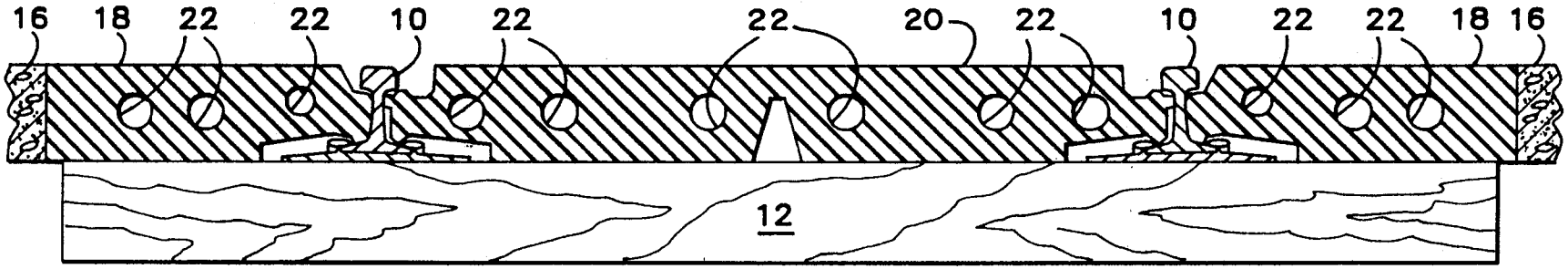
FIG. 2 is a sectional view taken along the line 2—2 of FIG. 1.
Figure 3:
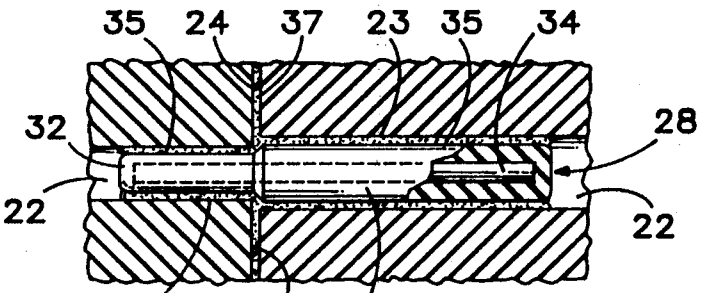
FIG. 3 is a sectional view, at an enlarged scale, taken along the line 3—3 of FIG. 1.

Referring now to FIGS. 2 and 3, the panels 18 and 20 have cylindrical passageways 22 extending through them. The passageways 22 are oriented in the panel such that they will be parallel with the rails 10 when the panels are installed. In the preferred embodiment illustrated, the passageways have a circular cross section and are tapered. Thus, the openings 23 formed in one face 24 of the panels are larger than the openings 25 located in the opposed face 26, FIG. 3.

Figure 7:
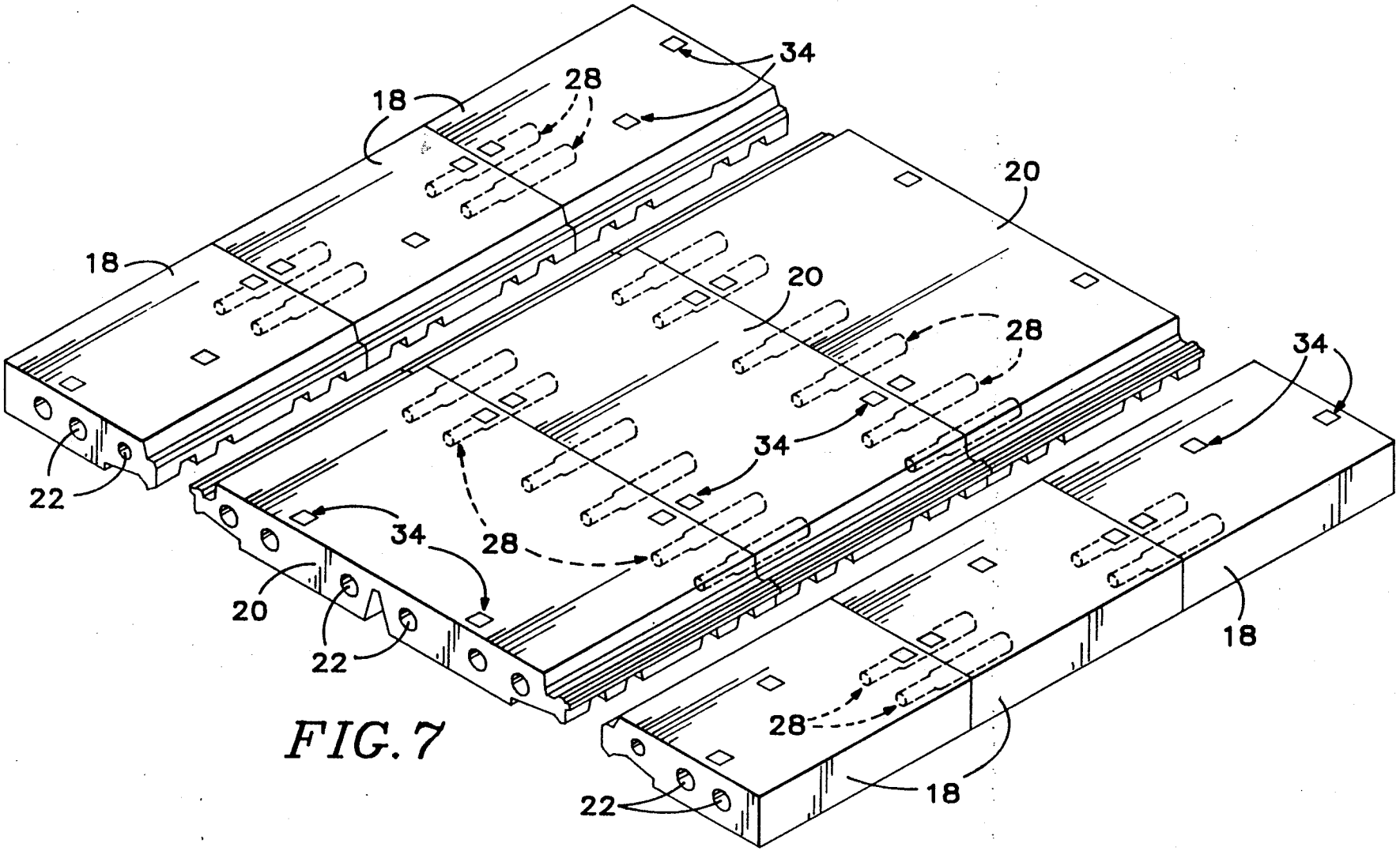
FIG. 7 is a perspective view showing a first embodiment of the panels of the subject invention.
Figure 8:
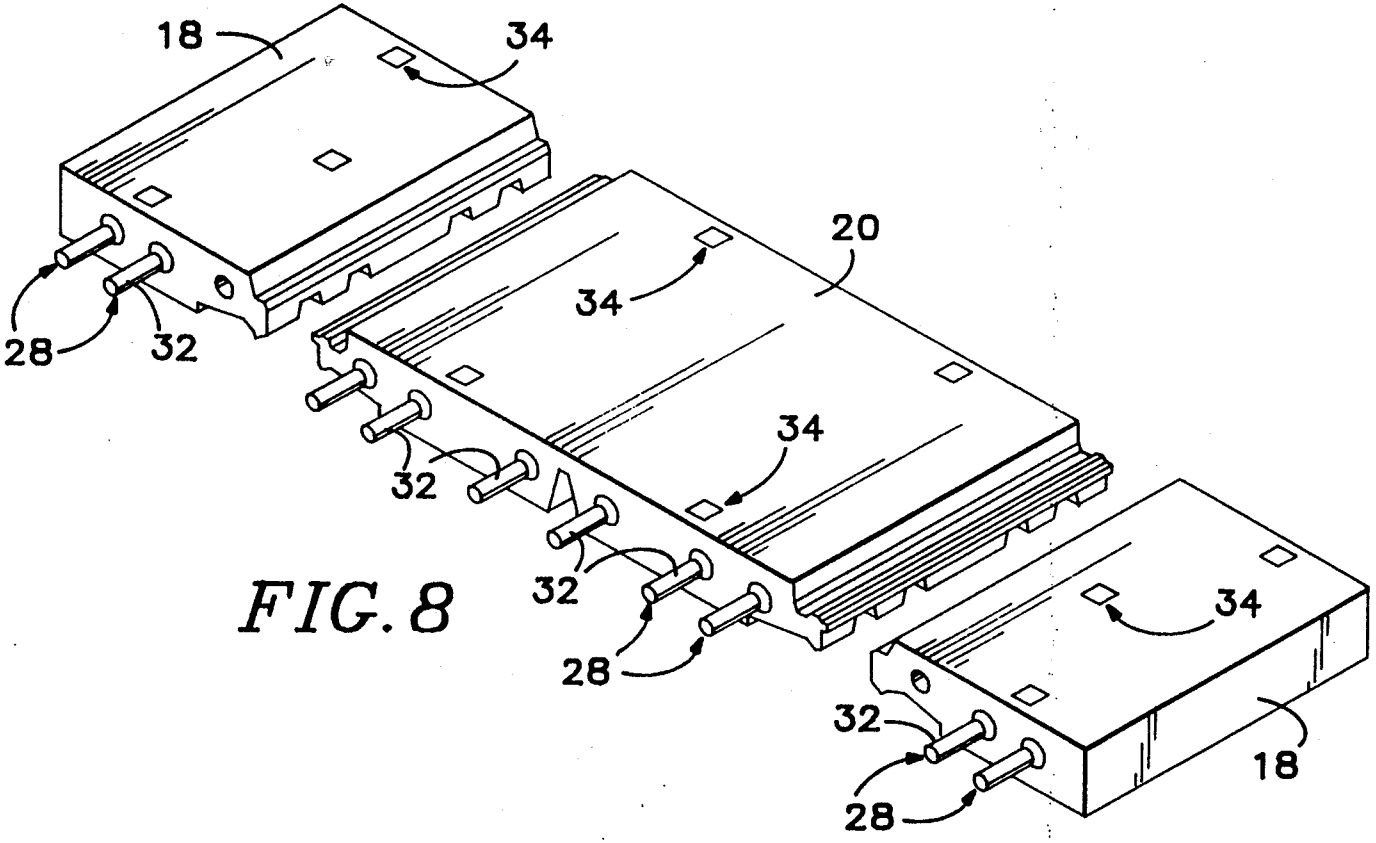
FIG. 8 is a perspective view showing a second embodiment of the panels of the subject invention.

The panels are joined end to end to form integral multiple panel crossing units. The panels can either be joined prior to installation so that the crossing units are installed as an integral assembly, FIG. 7, or joined during installation, FIG. 8. The panels are joined together by inserting pins 28 into the passageways 22. The pins 28 are cylindrical and are divided into a larger end 30 that fits in the larger openings 23, and a smaller end 32 that fits into the smaller openings 25. The pins preferably are made from an elastomeric material that is compatible with the panels, and have rigid cores, such as bars 34, installed in them.

Figure 6:
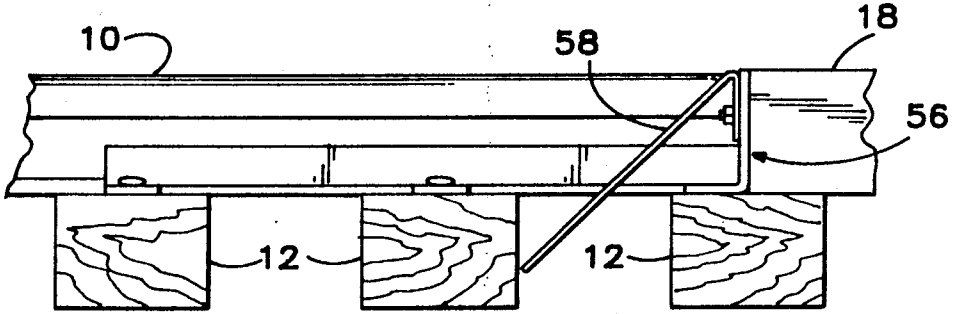
FIG. 6 is a sectional view taken along the line 6—6 of FIG. 1.

In the embodiment where the panels are joined together upon installation, every panel is connected to its adjacent panels so each integrated crossing unit extends across the entire width of the crossing. In the embodiment where the panels are joined together before installation, FIG. 6, the units do not extend across the entire crossing, but include two to five panels and the pins are secured to the panels by means of adhesive 35. In addition, with this embodiment, adhesive 37 is placed between the faces 24, 26 of adjacent panels. This makes each unit freestanding and permits the unit to be lifted and installed as an integral assembly.

Figure 5:
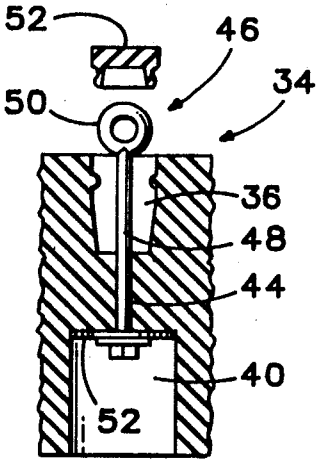
FIG. 5 is a sectional view, similar to FIG. 4, showing a lifting device that is part of the invention in its extended position.
Figure 4:
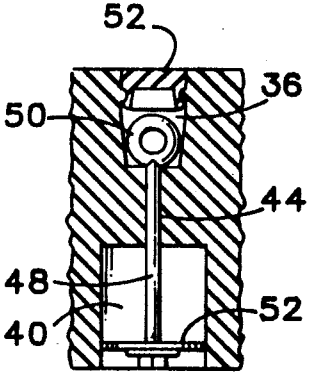
FIG. 4 is a sectional view, at an enlarged scale, taken along the line 4—4 of FIG. 1.

Referring now also to FIGS. 4 and 5, with the preassembled embodiment attachment assemblies 34 are placed at selected locations in the panels to facilitate lifting the assembled crossing units with a lifting device, such as a back hoe or crane (not shown). The attachment assemblies include first cavities 36 that open upwardly from the top surface of the panels, and second cavities 40 which lie immediately below the first cavities and open downwardly from the bottom surfaces of the panels. The first and second cavities are separated from one another except for a small passageway 44 that extends between them. Located in each first and second cavity is a lifting element 46. The lifting element has a thin body 48 that slidably communicates with the passageway 44, an eye 50, located at the top of the body 48, fits within the first cavity, and a stop 52, located at the bottom of the body 48, that fits within the second cavity. The eye and stop are both too large to fit through the passageway 44. The length of the body 40 is such that the lifting element is movable between a retracted position, FIG. 4, where the eye 50 is located completely within the first cavity 36, and an extended position, FIG. 5, where the eye 50 projects out of the first cavity. A plug 52 fits in each first cavity when the associated lifting element is in its retracted position.

Due to the weight of the crossing units it is not necessary that the panels be attached to the ties as is required with individual panels. However, the panels can be secured to the ties by conventional fasteners if desired. It is necessary to provide some means to prevent the crossing from moving along the rails. This is accomplished by end restraints 56, FIG. 6, that attach to the ties. A deflector panel 58 fits over each end restraint 56 to protect the exposed outside edges of the end panels.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A system for interconnecting elastomeric panels, that extend between a pair of parallel rails and between each rail and the edge of a roadway that crosses the rails, to form integral multiple panel grade crossing units, said system comprising:

(a) a plurality of elastomeric panels each having opposed vertical faces which abut adjacent panels and a plurality of elongate passageways that extend between said opposed faces, said passageways being tapered so as to present a relatively smaller opening on one of said faces and a relatively larger opening on the opposed face, and being aligned with the rails when the panels are in place in a grade crossing; and (b) elongate pins that snugly communicate with said passageway, each of said pins being divided into a larger end that corresponds to said larger openings and a smaller end that corresponds to said smaller openings.

2. The system of claim 1 wherein said pins are made from an elastomeric material.

3. The system of claim 2 wherein said pins have a rigid core.

4. The system of claim 1 further including end restraint means for preventing movement of said elastomeric panels along said rails.

5. The system of claim 4 wherein the rails are carried on ties and said restraint means are attached to said ties.

6. The system of claim 1 wherein said pins are adhesively affixed to the panels.

7. The system of claim 6 wherein said faces on the panels that are adjacent to one another are adhesively affixed to one another.

8. The system of claim 7 wherein said panels include attachment means for lifting the grade crossing units.

9. The system of claim 8 wherein said attachment means comprises:

(a) a first cavity that opens upwardly from said panel;

(b) a second cavity that lies directly below said first cavity but is separated therefrom;

(c) said first and second cavities being interconnected by a passageway;

(d) a lifting element having an eye located at the upper end thereof that fits within said first cavity and will not pass through said passageway;

(e) a stop located at the lower end of said lifting element that fits within said second cavity and will not pass through said passageway; and (f) a body which interconnects said eye and said stop and slidably fits in said passageway to permit movement of said attachment means between a retracted position wherein said eye is completely enclosed within said first cavity and an extended position wherein said eye protrudes from said first cavity.

10. The system of claim 9 including a plug which covers said first cavity when said attachment means is in its retracted position.

* * * * *